US005931472A

United States Patent [19]

Ko

[11] Patent Number: 5,931,472

[45] Date of Patent: Aug. 3, 1999

[54] PAI GOW GAME

[76] Inventor: Shenli Ko, 6811 San Ricardo Ave. #201, Las Vegas, Nev. 89102

[21] Appl. No.: 08/944,804

[22] Filed: Oct. 6, 1997

[51] Int. Cl.[6] ..... A63F 1/00

[52] U.S. Cl. ..... 273/292

[58] Field of Search ..... 273/292, 303, 273/304, 305

[56] References Cited

U.S. PATENT DOCUMENTS 5,653,444 8/1997 Dahl ..... 273/292 X
5,660,392 8/1997 Hansen ..... 273/292
5,685,774 11/1997 Webb ..... 273/292 X
5,697,614 12/1997 Patter et al. ..... 273/292
5,713,574 2/1998 Hughes ..... 273/292
5,725,216 3/1998 Jones ..... 273/292

*Primary Examiner*—William E. Stoll
*Attorney, Agent, or Firm*—Quirk & Tratos

[57] ABSTRACT

An improved game of Pai Gow is set forth which includes offering the player an optional bonus wager. Should the tiles of the Player's hand match any predetermined bonus outcome tile combination, the Player receives a reward for their bonus wager regardless of whether or not the Player has won their hand according to the rules of Pai Gow.

7 Claims, 3 Drawing Sheets

PAI GOW GAME

FIELD OF THE INVENTION

The present invention relates to the Chinese game of Pai Gow played using a field of playing tiles or dominos.

BACKGROUND OF THE INVENTION

Pai Gow is an ancient Chinese game which name translates into "making nines." The game is played using a set of 32 playing tiles resembling dominos. FIG. 1 illustrates the set of 32 tiles having red (shown as black in FIG. 1) and white dots used for playing the game showing certain combinations in order of ranking as is well known in the play of Pai Gow. As stated previously, the play of the game of Pai Gow is well known and is played in numerous casinos around the world as a wagering, casino game.

Basically to play the game, players make a wager before the start of a hand. A dealer shuffles or mixes the set of tiles and makes eight stacks of four tiles each. Dice are rolled to determine who gets the first stack of tiles. The tiles are then distributed in order to each player and the dealer. The players look at their four tiles and arrange them into two hands, a high and a low hand, of two tiles each. The low hand is to have a lower Pai Gow ranking than the high hand according to the ranking of hands of Pai Gow which is well known. After the players have arranged their hands, they place the two tile low hand in front of the two tile high hand, with the tiles face down, in front of them. The dealer then turns over his/her four tiles and arranges them in a high and low hand like the players according to the ranking of hands of Pai Gow. Each player's hands are then resolved in turn against the dealer's. If both of the player's high and low hands outrank the dealer's high and low hands, the player wins their wager and is paid even money. Most casinos exact a commission of typically five percent (5%) on winning hands. If one, but not both, of the player's hands outrank the dealer's hands, the hand is considered a tie or push and the player neither loses nor wins their wager. If the dealer's hands outrank both of the player's hands, that is deemed to be a losing outcome and the player loses their wager.

In Pai Gow, a player, should they so desire, can declare themselves the banker whereby that player plays against all of the other players and the dealer in a like manner.

One of the drawbacks of Pai Gow is that a player can have two extremely high ranking low and high hands and still end up with a push if one of the dealer's hands outranks one of the player's. This can be frustrating as a player who may only rarely see such a combination of hands.

A further drawback is that a player cannot expect to receive a large reward several times their initial wager. For a player to win a large amount they must risk a large amount. Pai Gow does not provide any mechanism to offer high rewards to players with a relatively small amount of risk.

Still a further drawback is that many players are unfamiliar with the game of Pai Gow and hence refrain from playing the game. Knowledge of the game and skill is required to arrange the hands. If a hand is improperly arranged such that the high hand does not outrank the low hand, the play is deemed a loss for the player. This unfamiliarity with the game has often relegated the play of the game to those having an intimate knowledge of the game.

There is therefore a need for an improved Pai Gow game which overcomes the drawbacks noted above by providing opportunities to reap greater rewards, by rewarding players who obtain certain combinations regardless of the ultimate outcome of the hand and which provides for wagering opportunities even to those unfamiliar with the play of the game and the ranking of Pai Gow hands.

SUMMARY OF THE INVENTION

There is therefore set forth according to the present invention a method for playing an improved game of Pai Gow which may be embodied in either a table game format or in an electronic device.

The method includes the player prior to the dealing of the tiles opting to make at least one of a base wager and a bonus wager. The player need not make the base wager to participate in the game and can make only a bonus wager. Similarly a player need not make a bonus wager. A player can opt to make both of the base and bonus wagers. After the wagering options have been exercised, the dealer deals four tiles to each player and the dealer in the traditional Pai Gow fashion. Each player and the dealer arrange their tiles into the two tile high hand and the two tile low hand, the high hand having a higher ranking than the low hand according to the rules of ranking of Pai Gow hands, also in the traditional fashion. If the player has made a base wager and both his high and low hands outrank the dealer's corresponding high and low hands, the player is declared to have obtained a winning outcome and the player is rewarded based upon their base wager. As in traditional Pai Gow the reward on the base wager is usually a payoff of even money with the casino exacting a five percent (5%) commission on winning hands. If one, but not both, of the player's high and low hands outranks a corresponding one of the dealer's high and low hands, the outcome is declared a push and the player neither loses nor wins their wager. All other outcomes are deemed a loss and the player loses their base wager.

If the player has made a bonus wager and his four tiles include one of pre-selected bonus tile combinations, the player is declared to have obtained a bonus outcome and the player is rewarded based upon the amount of their bonus wager. The bonus tile outcome combinations may be any selected combinations but preferably are combinations of (a) Supreme and Heaven pair, (b) Supreme and Earth pair, (c) Heaven pair and Earth pair, (d) Lame Duck, (e) two pair, (f) Supreme, Heaven or Earth pair, (g) one pair or (h) a Wong or Gong, combinations which are familiar in the game of Pai Gow.

Like the traditional game of Pai Gow, a player may elect to be the Banker for a hand and therefore plays against the dealer and the remaining players for the base wagers only. Preferably according to the method of the present invention the casino always books the bonus wagers for the players.

The payoffs for winning bonus wagers may range from even money to, for example, 200:1.

As can be appreciated, the game provides for players to obtain high rewards during the play of Pai Gow. Rather than simply winning even money (less a commission) for the base wagers, players can participate in the bonus wager and reap greater rewards.

Furthermore, a player having made a bonus wager and obtaining a qualifying bonus combination is rewarded regardless of whether or not his base wager is won or lost. Furthermore, by providing the bonus feature, players unfamiliar with the game can simply make bonus wagers and if their four tiles achieve a qualifying bonus outcome, they can win. They need to know nothing about the arranging of the high and low hands to participate in the game.

BRIEF DESCRIPTION OF THE DRAWINGS

These and other features and advantages will become better appreciated as the same becomes better understood with reference to the claims, specification and drawings wherein

DESCRIPTION

Turning to the drawings, the improved Pai Gow game according to the present invention will now be described.

Figure 1:
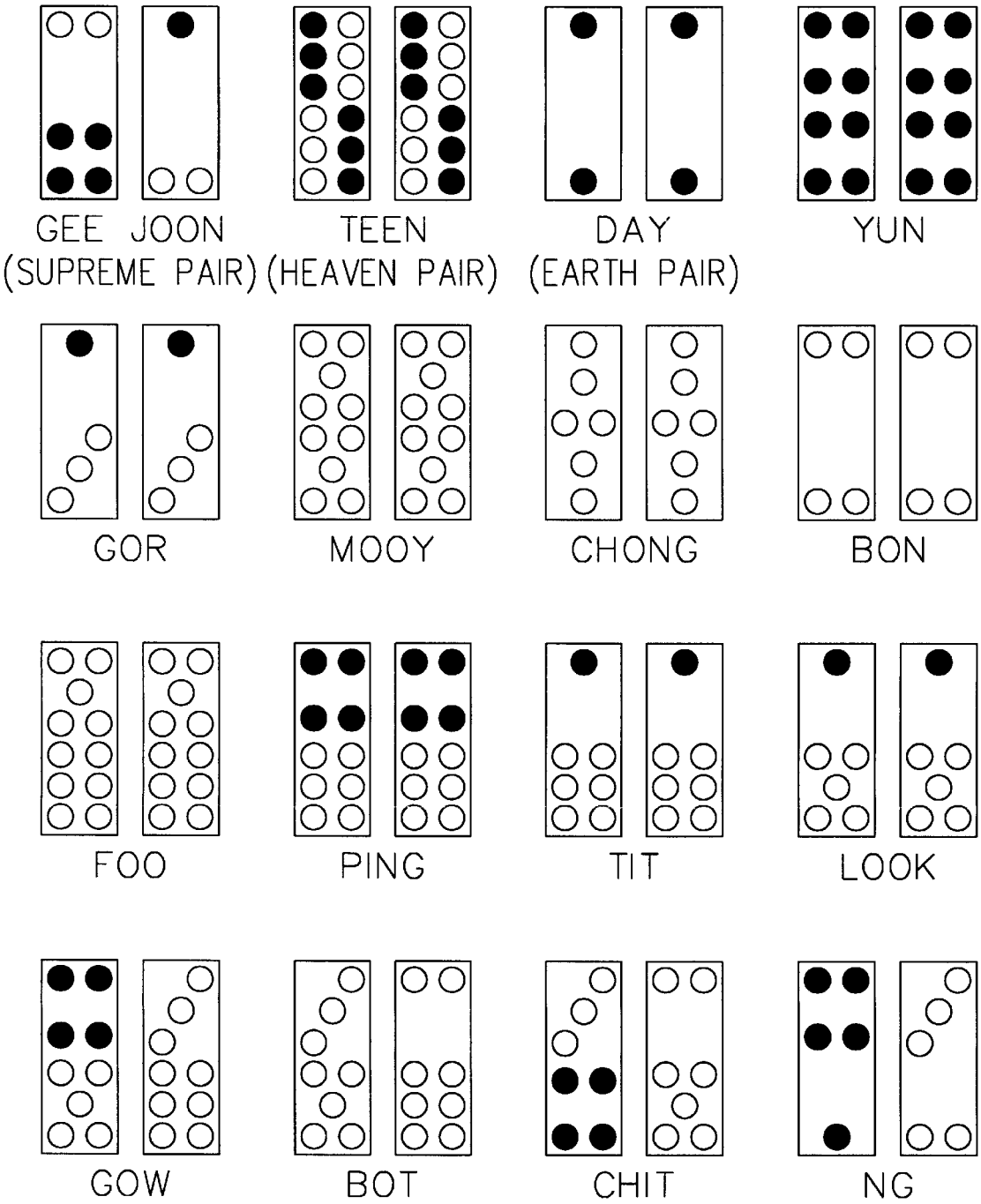
FIG. 1 shows the 32 Pai Gow playing tiles arranged in certain highly ranked pairs in the order of ranking according to the rules of Pai Gow.
Figure 2:
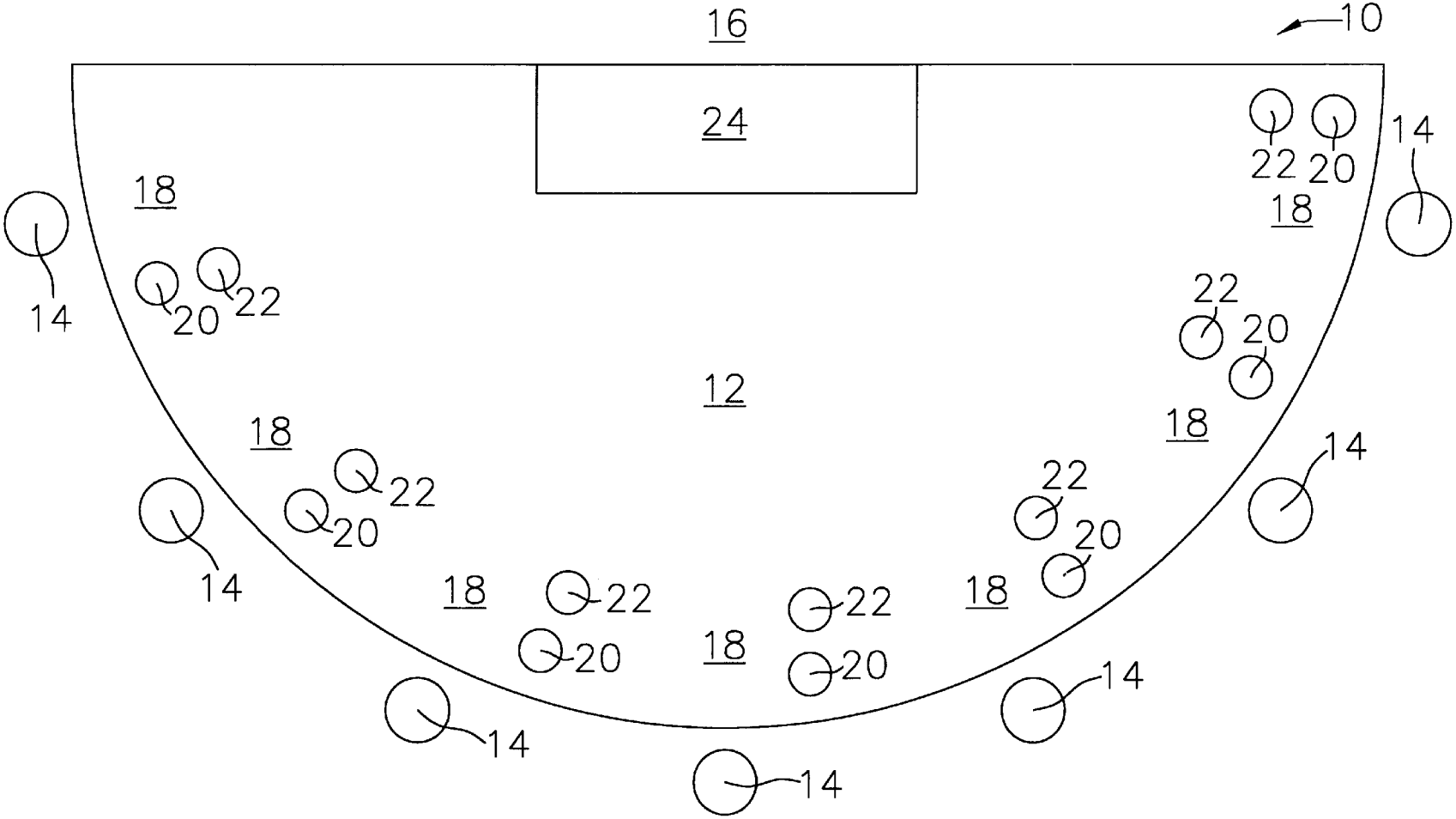
FIG. 2 illustrates a table layout for the play of the Pai Gow game according to the present invention.

With reference to FIG. 2, a layout 10 for play of the game is illustrated. The layout 10 includes a playing surface 12 of generally known construction defining seven player positions 14 and a dealer position 16. Players sitting at the player positions 14 have presented in front of them an action area 18 where players receive and arrange their tiles according to the play of Pai Gow in a known fashion. Adjacent each action area is a base wager area 20 where the player makes a base wager and a bonus wager area 22 where the player places their bonus wager. In front of the dealer position 16 is a check tray 24 which holds chips or checks during the play of the game.

With the layout 10 now described, the play of the improved game of Pai Gow according to the present invention will now be described. While the following description is directed to play of the improved game as a live action game, it is to be understood that the method according to the present invention could be incorporated into an electronic device for play thereat by a player.

To play the game, each player opts to make one or both of a base wager and a bonus wager. The player need not make both and can make only one as desired to participate in the game. Depending upon the wager or wagers desired by the player, the player places their base wager in the base wager area 20 and any bonus wager in the bonus wager area 22 to signify to the dealer that the wagers are being made. Table minimums and maximums may dictate the minimum and maximum amount of such wagers that can be made by the player.

Furthermore, should a player so desire, the player can declare themselves the Banker for the hand in a manner well known with the play of traditional Pai Gow. If the player so declares themselves to be the Banker, they then play against the other players and the dealer and in essence book the base wagers. However, typically the dealer, supplied by a casino, acts by default as the Banker for the hands. The following description will assume that no player has declared themselves the Banker for the hand and therefore the casino dealer acts as the Banker.

In advance of dealing the hand, the dealer mixes the Pai Gow tiles and, as is well known, arranges the thirty two tiles in eight hands of four tiles each. After the players have made their wagers, the dealer shakes dice to determine who will get the first stack of tiles. This too is the same as is in traditional Pai Gow. Thereafter the hands of four tiles are distributed to the players and the dealer as determined by the outcome of the dice. If less than seven players are playing the game, undistributed hands are removed from play and set aside.

The player having received their four tiles, arranges their tiles into a two tile high hand and a two tile low hand, the high hand having a higher ranking than the low hand according to the rules of ranking of Pai Gow. This is the same as is in traditional Pai Gow. Once the players have arranged the tiles into the hands, they set their two tile hands in front of them face down. Thereafter, the dealer turns over his/her tiles and arranges them into a two tile low hand and a two tile high hand according to the same rules discussed above. The player's hands are then resolved in order against the dealer's hands to determine if the player has obtained a winning, losing or tie outcome. For players only making bonus wagers, the arrangement of the hands is not required.

For players having made the base wager and where both their high and low hands outrank the dealer's high and low hands, the player is declared to obtain a winning outcome and the player is rewarded even money for their base wager less a commission for the casino. Because Pai Gow is a relatively even game, the casino exacts a commission, typically five percent (5%) from winning hands, to pay for hosting of the game. If one, but not both, of the player's low and high hands outrank the dealer's, the outcome is declared to be a push and the player neither wins nor loses their wager. If the Banker\dealer's low and high hands outrank the player's low and high hands, that is deemed to be a losing outcome for the player and the base wager is lost. Furthermore, if the player has misarranged their hands such that the high hand does not outrank the low hand that too is determined to be a losing outcome.

Figure 3:
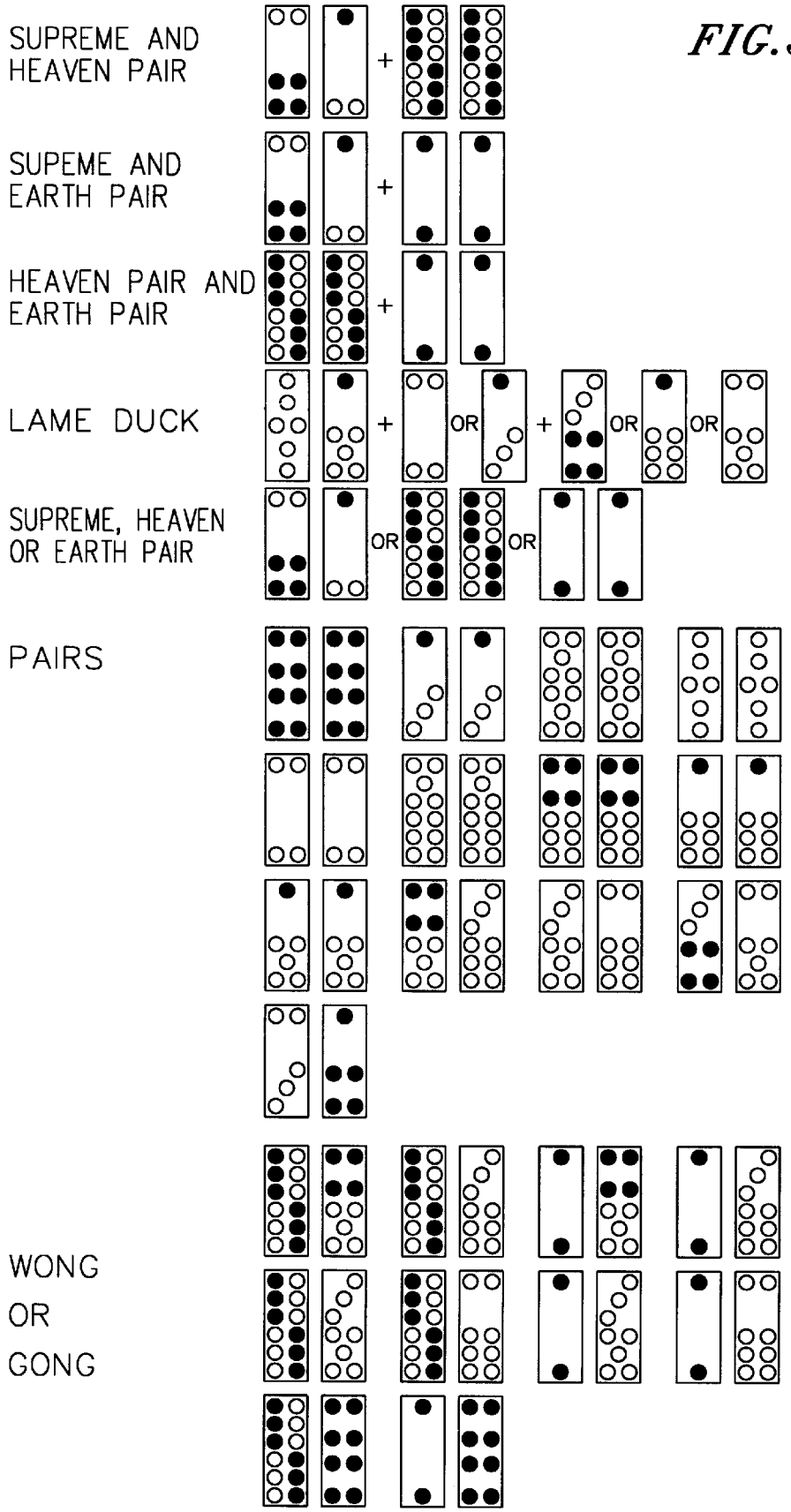
FIG. 3 shows the certain bonus combinations according to the preferred embodiment of the present invention.

For those players having made the bonus wager, the make-up of the player's four tiles is compared to determine whether one or more pre-determined bonus combinations can be formed. While any suitable combination or arrangement can be selected as a bonus combination, preferably, and with reference to FIG. 3, the following combinations are deemed to be bonus combinations: Supreme and Heaven pair, Supreme and Earth pair, Heaven pair and Earth pair, Lame Duck (Lame Duck is a high 6, low 6, one of the 4's and one of the 7's), two pairs, Supreme, Heaven or Earth pair, one pair, Wong or Gong. The player's four tiles are examined to determine if a bonus combination can be made regardless of whether or not they appear in the high or low hand combinations or whether or not the player has obtained a winning outcome for any base wager.

If the player has obtained a bonus outcome, the player is paid with a payoff based upon the amount of their bonus wager. Preferably the bonus payout schedule is as shown in Table 1 below:

TABLE 1

| BONUS HAND | PAYOUT |
|---|---|
| Supreme and Heaven Pair | 200:1 |
| Supreme and Earth Pair | 100:1 |
| Heaven Pair and Earth Pair | 50:1 |
| Lame Duck | 20:1 |
| Two Pair | 10:1 |
| Supreme, Heaven or Earth Pair | 3:1 |
| One Pair | 2:1 |
| Wong or Gong | 1:1 |

Preferably only the highest ranking outcome is used to determine the payout.

As stated above, even if a player has obtained a losing outcome for their base wager, they may have in their hand a bonus combination entitling them to a bonus payoff. Furthermore, the player may not even participate in the base game and may simply make bonus wagers and hope to obtain a bonus outcome. A player desiring not to play the bonus wager can simply play the base wager game which is traditional Pai Gow.

The game thus described provides Pai Cow players with an opportunity to reap great rewards of up to 200:1 or the like by making a bonus wager. This contributes to the excitement of the play of Pai Gow. Furthermore, players unfamiliar with Pai Gow may simply make bonus wagers making the game more available to players who are completely unfamiliar with the game. As they play bonus wagers they may become more familiar with the game and thereafter decide to participate in the base wagers as well. Accordingly, the game provides players with various options as to how to play the game and provides, with the bonus wager, an opportunity to reap a payoff many times the amount of the wager. Still further, a player can receive a bonus payout even though they may lose a base wager to the dealer/Banker. As a further advantage, by selecting the bonus combinations as described above, there will be frequent payoffs. It is estimated that a bonus will be paid to a player once in every three hands. This will sustain the player's interest in the game. Furthermore, while a Lame Duck is considered an extremely poor hand, obtaining a Lame Duck, if the player has made a bonus wager, will entitle the player to a payoff of 20:1. This makes the bonus wager in addition to the base wager the equivalent of buying insurance against an extremely poor hand. Obtaining a Lame Duck for a player, which would normally be disappointing to a player playing the base game, would turn the event into a pleasant surprise for the player. Still further no skill is required to play the bonus wager. The dealer will identify the highest ranking bonus outcome even if the player cannot identify it by himself. It is believed that this game will help cultivate new players to the game as they become more familiar with how to identify the hand combinations. Ultimately these players will wish to participate in the base game and set their own hands.

Still further, since in regular Pai Gow, pushes occur approximately forty percent (40%) of the time, even in a push situation the player may obtain a bonus payoff. This increases the excitement for the players. Furthermore, for those players who have also made the bonus wager, pushes will still result in action, a win or a loss, for the bonus wager. Still further, while the casino advantage is reduced to about 1½% if a player acts as the Banker for every other hand, the advantage on the bonus wager remains fixed at approximately 4.28%. This means additional revenues for the casino. Still further, regardless of whether or not a player acts as the Banker for the hand, the house or casino always banks the bonus wagers and collects losing bonus wagers or pays for obtaining a bonus combination.

While I have shown and described certain embodiments of the present invention it is to be understood that it is subject to modifications without departing from the spirit and scope of the claims.

I claim:

1. An improved method for playing a game of Pai Gow using a field of tiles wherein the Player makes a base wager, and a hand is dealt consisting of four tiles dealt to each of the Player and a Banker, each of the Player and Banker arranges their tiles into a two tile high hand and a lower ranking two tile low hand, comparing the respective high and low hands of the Player and the Banker and rewarding the Player based upon his base wager if both of his hands outrank the Banker's hands, the Player losing his base wager if his hands are outranked by the Banker's hands and declaring all other outcomes a push, the improvement comprising:

selecting certain tile combinations as winning bonus outcomes;

the Player making a bonus wager prior to dealing of the hand whether or not he has made a base wager;

comparing the Player's tiles for the hand to said selected bonus outcome combinations; and rewarding the Player for obtaining a winning bonus outcome based upon his bonus wager and the Player losing his bonus wager for failing to obtain a bonus outcome combination.

2. The method of claim 1 including rewarding the Player for only the highest ranking bonus tile combination.

3. The method of claim 1 including establishing the bonus tile combinations as (a) Supreme and Heaven Pair, (b) Supreme and Earth pair, (c) Heaven Pair and Earth Pair, (d) Lame Duck, (e) Two pair, (f) Supreme, Heaven or Earth Pair, (g) one Pair or (h) Wong or Gong.

4. The method of claim 3 including rewarding the Player based upon his bonus wager substantially according to Table 1 if the Player obtains from his four tiles one of the bonus combinations

TABLE 1

| Bonus Combination | Payout |
|---|---|
| Supreme and Heaven Pair | 200 to 1 |
| Supreme and Earth Pair | 100 to 1 |
| Heaven Pair and Earth Pair | 50 to 1 |
| Lame Duck | 20 to 1 |
| Two Pair | 10 to 1 |
| Supreme, Heaven or Earth Pair | 3 to 1 |
| One Pair | 2 to 1 |
| Wong or Gong | 1 to 1. |

5. An improved method for playing a game of Pai Gow using a field of tiles wherein the Player makes a base wager, a hand is dealt consisting of dealing four tiles to each of the Player and a Banker, each of the Player and Banker arranges their tiles into a two tile high hand and a lower ranking two tile low hand, comparing the respective high and low hands of the Player and the Banker and rewarding the Player based upon his base wager if both of his hands outrank the Banker's hands, the Player losing his base wager if his hands are outranked by the Banker's hands and declaring all other outcomes a push, the improvement comprising:

designating as winning bonus outcomes the tile combinations of (a) Supreme and Heaven Pair, (b) Supreme and Earth pair, (c) Heaven Pair and Earth Pair, (d) Lame Duck, (e) Two pair, (f) Supreme, Heaven or Earth Pair, (g) one Pair or (h) Wong or Gong;

the Player making a bonus wager prior to dealing the hand whether or not he has made a base wager;

comparing the Player's tiles of his hand to said designated bonus outcome tile combinations; and rewarding the Player for obtaining a winning bonus outcome combination based upon his bonus wager and the Player losing his bonus wager for failing to obtain a bonus outcome combination.

6. The method of claim 5 including the dealer rewarding the Player for only the highest ranking bonus tile combination.

7. The method of claim 6 including the dealer rewarding the Player based upon his bonus wager substantially according to Table 1 if the Player obtains from his four tiles one of the bonus combinations

TABLE 1

| Bonus Combination | Payout |
|---|---|
| Supreme and Heaven Pair | 200 to 1 |
| Supreme and Earth Pair | 100 to 1 |
| Heaven Pair and Earth Pair | 50 to 1 |
| Lame Duck | 20 to 1 |
| Two Pair | 10 to 1 |
| Supreme, Heaven or Earth Pair | 3 to 1 |

TABLE 1-continued

| Bonus Combination | Payout |
|---|---|
| One Pair | 2 to 1 |
| Wong or Gong | 1 to 1. |

* * * * *